US005679624A

United States Patent [19]

Das

[11] Patent Number: 5,679,624

[45] Date of Patent: Oct. 21, 1997

[54] HIGH TC SUPERCONDUCTIVE KTN FERROELECTRIC TIME DELAY DEVICE

[76] Inventor: Satyendranath Das, P.O. Box 574, Mt. View, Calif. 94042-0574

[21] Appl. No.: 571,223

[22] Filed: Dec. 12, 1995

Related U.S. Application Data

[63] Continuation of Ser. No. 35,321, Feb. 24, 1995, abandoned.

[51] Int. Cl.[6] ..... H01P 9/00; H01B 12/02

[52] U.S. Cl. ..... 505/210; 505/700; 505/701; 505/866; 333/99 S; 333/161

[58] Field of Search ..... 333/161, 99 S; 505/210, 700, 701, 866

[56] References Cited

U.S. PATENT DOCUMENTS 4,614,922 9/1986 Baumann et al. ..... 333/161
5,409,889 4/1995 Das ..... 333/161 X
5,472,935 12/1995 Yandrofski et al. ..... 333/161 X

OTHER PUBLICATIONS

Jackson, C.M., et al; "Novel Monolithic Phase Shifter Combining Ferroelectrics and High Temperature Superconductors"; *Microwave and Optical Technology Letters;* vol. 5, No. 14, 20 Dec. 1992 pp. 722–726.

Lyons W.G. and Withers R.S.; "Passive Microwave Device Application of High Tc Superconducting Thin Films"; *Microwave Journal;* Nov. 1990; pp. 85, 86, 90, 92, 96, 98, 100, 102.

*Primary Examiner*—Benny T. Lee

[57] ABSTRACT

A number of MMIC ferroelectric variable time delay devices are presented. Each embodiment has a microstrip configuration deposited on a ferroelectric film which is deposited on a high Tc superconductor substrate connected to the ground. A bias electric field changes the permittivity of the ferroelectric material. As a result, a variable time delay is obtained.

19 Claims, 7 Drawing Sheets

HIGH TC SUPERCONDUCTIVE KTN FERROELECTRIC TIME DELAY DEVICE

This application is a continuation of, the detailed description of the preferred embodiment being identical to, the application Ser. No. 29/035,321, filed Feb. 24, 1995, now abandoned.

FIELD OF THE INVENTION

The present invention relates to time delay devices for electromagnetic waves and more particularly, to RF time delay devices which can be controlled electronically.

DESCRIPTION OF THE PRIOR ART

Ferroelectric materials have a number of attractive properties. Ferroelectrics can handle high Peak power. The average power handling capacity is governed by the dielectric loss of the material. They have low switching time (such as 100 nS). Some ferroelectrics have low losses. The permittivity of ferroelectrics is generally large, as such the device is small in size. The ferroelectrics are operated in the paraelectric phase, i.e. slightly above the Curie temperature. Inherently, they have a broad bandwidth. They have no low frequency limitation as contrasted to ferrite devices. The high frequency operation is governed by the relaxation frequency, such as 95 GHz for strontium titanate, of the ferroelectric material. The loss of the ferroelectric high Tc superconductor RF time delay device is low for ferroelectric materials with a low loss tangent. A number of ferroelectrics are not subject to burnout. Ferroelectric time delay devices are reciprocal.

There are three deficiencies to the current technology: (1) The insertion loss is high as shown by Das, U.S. Pat. No. 5,451,567. The present invention uses low loss ferroelectrics as discussed by Rytz et al. D Rytz, M. B. Klein, B. Bobbs, M. Matloubian and H. Fetterman, "Dielectric Properties of $KTa_{1-x}Nb_xO_3$ at millimeter wavelengths," J. Appl. Phys. vol. 24 (1985), Supp. 24-2, pp. 1010–1012, and to reduce the conductor losses, uses a high Tc superconductor for the conductor. (2) The properties of ferroelectrics are temperature dependent as discussed by Rytz et al. This invention uses the phase shifters at a constant high Tc superconducting temperature. (3) The third deficiency is the variation of the VSWR over the operating range of the time delay device. The present invention uses a ferroelectric quarter wave matching transformer to obtain a good VSWR over the operating bias electric field range of the time delay device. The bandwidth of the time delay device can be extended by using more than one matching transformer.

Depending on a trade-off study in an individual case, the best type of time delay device can be selected.

SUMMARY OF THE INVENTION

The general purpose of this invention is to provide an electronically controlled variable time delay device which embraces the advantages of similarly employed conventional devices such as ferrite and semiconductor phase shifters. This invention, in addition, reduces the conductive losses.

It is an object of this invention to provide a voltage controlled ferroelectric time delay device which uses lower control power and is capable of handling high peak and average powers than conventional time delay device. High Tc superconducting materials can handle a power level of up to 0.5 MW. Another objective of this invention is to build reciprocal time delay devices with a low loss. Another objective is to have a time delay device operating from a low frequency to up to at least 95 GHz.

These and other objectives are achieved in accordance with the present invention which comprises a microstrip line having an input matching section, a time delay device section and an output matching section. The time delay device section is constructed from a solid or liquid ferroelectric material, including $KT_{a1-x}Nb_xO_3$ (KTN), where the value of x varies between 0.005 and 0.7, the permittivity of which changes with the changes in the applied bias electric field. This change in the permittivity produces a time delay or phase shift. By selecting an appropriate percentage of niobium titanate in the $KTa_{1-x}Nb_xO_3$, where the value of x varies between 0.005 and 0.7, Curie temperature of the ferroelectric material can be brought slightly lower than the high Tc of a superconducting material. Strontium titanate and lead titanate composition is an example of another ferroelectric. The embodiments are operated slightly above the Curie temperature of the ferroelectric material to avoid hysterisis which is present at temperatures below the Curie temperature. To obtain a low loss tangent, a single crystal embodiment of the ferroelectric material is selected. Each embodiment has a microstrip configuration deposited on a ferroelectric film which is deposited on a single crystal high Tc superconductor substrate which in turn is connected to ground.

With these and other objectives in view, as will hereinafter more fully appear, and which will be more particularly pointed out in the appended claims, reference is now made to the following description taken in connection with accompanying drawings.

DETAILED DESCRIPTION OF THE PREFERRED EMBODIMENT

Figure 1:
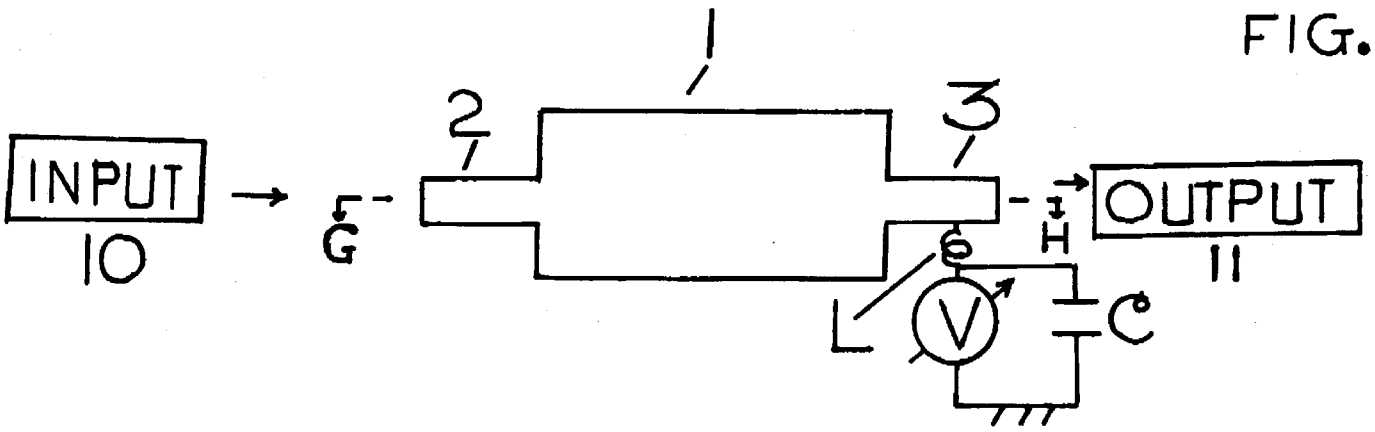
FIG. 1 is a top view of a transmission line embodiment of my invention.

FIG. 1 is a top view of an embodiment of my invention. It is a film of a single crystal high Tc superconductor material, such as YBCO, and is a part of a monolithic single crystal ferroelectric time delay device. The time delay device microstrip line is 1. Generally, the permittivity of the ferroelectric film, below the single crystal high Tc superconductor film, is high and the resulting impedance of the microstrip line 1 is low. To match the impedance of the time delay device microstrip line 1 to the impedance of an input circuit of the time delay device, a quarter wavelength long, at an operating frequency of the time delay device, matching transformer 2 is used. For matching the impedance of the time delay microstrip line 1 to the impedance of the output circuit of the time delay device, a quarter wavelength long, at an operating frequency of the time delay device, matching transformer 3 is used. The time delay device is operated at a high Tc superconducting temperature slightly above the Curie temperature of the ferroelectric film. An inductance L provides a high impedance at an operating frequency of the time delay device. Any RF energy present after the inductance L is by passed to the ground by the capacitor C. A bias voltage V is applied to the time delay device to change the permittivity and as such the differential time delay of the time delay device. The input is 10 and the output is 11. The time delay device is reciprocal.

Figure 2:
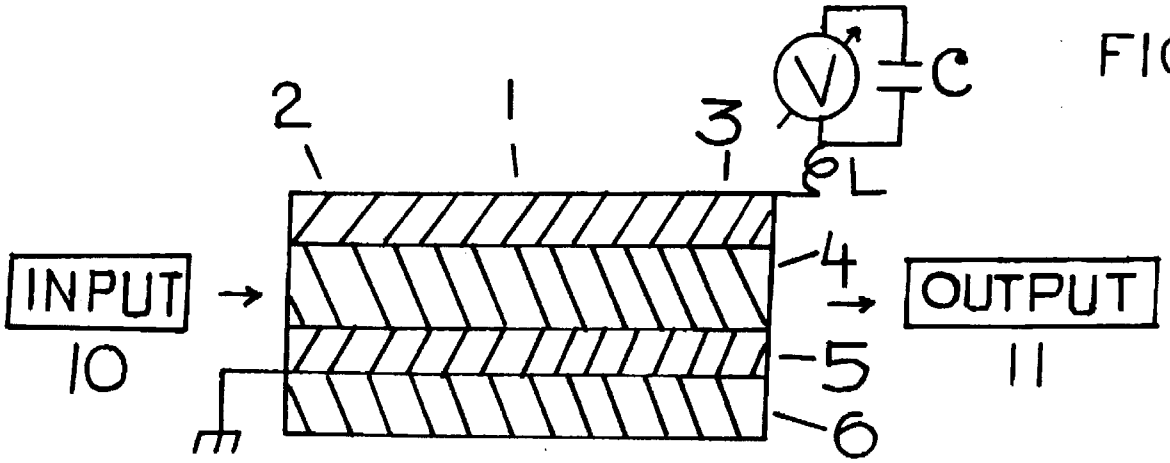
FIG. 2 is a longitudinal cross-section of FIG. 1 through section line GH.

FIG. 2 is a longitudinal cross-section of FIG. 1 through section line GH. A substrate 6 of a single crystal dielectric material, such as sapphire, is used. A layer of a film 5 of a single crystal high Tc superconductor, such as YBCO, is deposited on top of the single crystal dielectric material 6 and is connected to the ground. On top of the layer of a film 5 of the high Tc superconductor material, a layer of a film 4, of a single crystal ferroelectric material is deposited. On top of the film of the single crystal ferroelectric material 4 is deposited a layer of a film, designated 2, 1, 3, of a single crystal high Tc superconductor material. The inductance L provides a high impedance at an operating frequency of the time delay device. Any RF energy present after the inductance L is by passed by the capacitor C. An application of a bias voltage V changes the permittivity of the single crystal ferroelectric material 4 and the differential time delay of the time delay device. The time delay device is a monolithic microwave integrated circuit (MMIC). The input is 10 and the output is 11. The time delay device is reciprocal.

Figure 3:
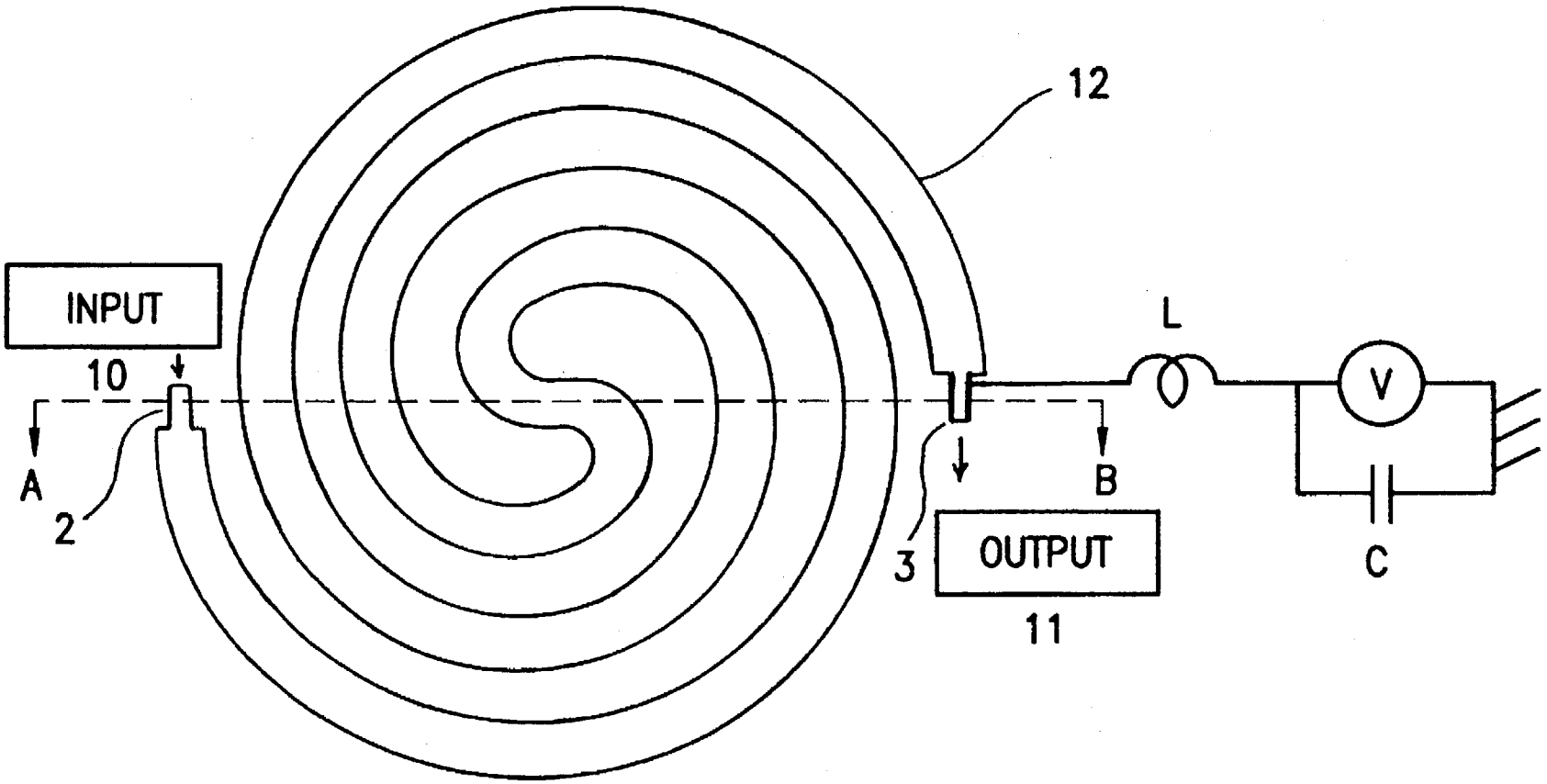
FIG. 3 is a top view of a spiral shaped embodiment of my invention.

FIG. 3 is a top view of another embodiment of my invention. It is a monolithic spiral shaped time delay device. A film of a single crystal high Tc superconductor material, on top of a single crystal ferroelectric film, is shown. Only a small number of turns is shown in the spiral for simplicity. The number of turns is designed to be n depending on the differential time delay required. The permittivity of a single crystal ferroelectric material is generally large and consequently the impedance of the microstrip line of the spiral is small. For matching the impedance of the microstrip line of the spiral time delay device 12 to the impedance of an input circuit of the time delay device, a quarter wavelength long, at an operating frequency of the time delay device, transformer 2 is used. For matching the impedance of the time delay device 12 to an impedance of the output circuit of the time delay device, a quarter wavelength long, at an operating frequency of the time delay device, transformer 3 is used. The inductance L provides a high impedance at an operating frequency of the time delay device. Any RF energy remaining after the inductance L is by passed to the ground by the capacitor C. A bias voltage V changes the permittivity of the single crystal ferroelectric material and consequently the differential time delay of the spiral time delay device. The time delay is operated at a high Tc superconducting temperature slightly above the Curie temperature of the ferroelectric film.

Figure 4:
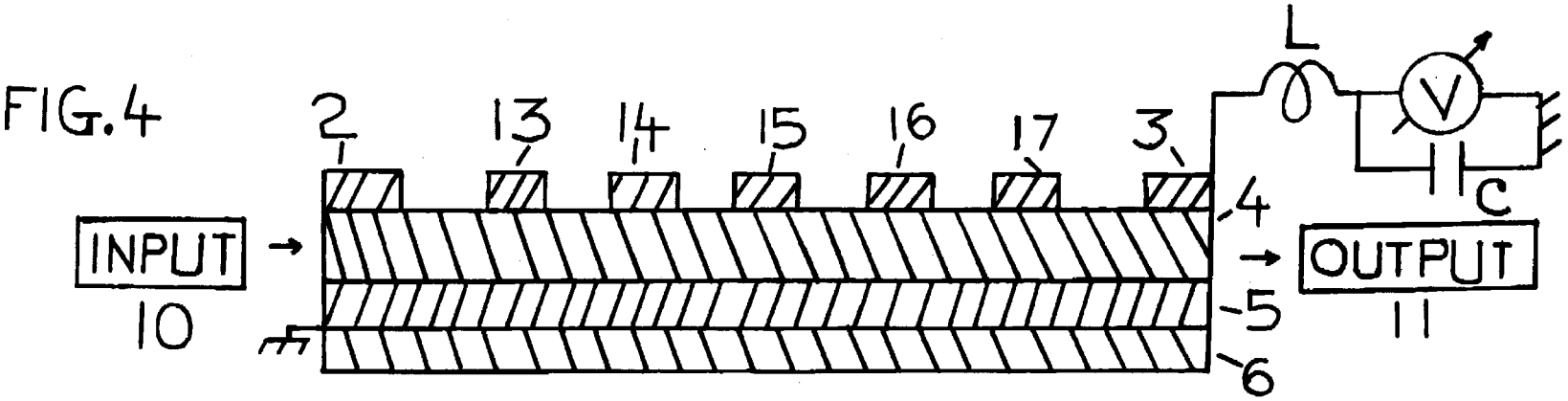
FIG. 4 is a longitudinal cross-section across section line AB of FIG. 3.

FIG. 4 is a longitudinal cross-section across section line AB of FIG. 3. A single crystal dielectric material, such as sapphire, substrate is 6. The bottom film of a single crystal high Tc superconductor material is 5 which is connected to the ground. A film of a single crystal ferroelectric material is 4. The cross-sections of the different sections of the spiral arms, made of a single crystal high Tc superconductor, such as YBCO, are shown by 13, 14, 15, 16 and 17. The input quarter wave impedance matching transformer is 2. The output quarter wave impedance matching transformer is 3. There are areas between 2 and 13, 13 and 14, 14 and 15, 15 and 16, 16 and 17, and 17 and 3, which are not deposited with a single crystal high Tc superconductor material. The inductance L provides a high impedance at an operating frequency of the time delay device. Any RF energy remaining after L is by passed to the ground by the capacitor C. A bias voltage V changes the permittivity of the film of a single crystal ferroelectric material and consequently the variable time delay of the time delay device. The spiral time delay device is a monolithic microwave integrated circuit (MMIC). The spiral time delay device is operated at a high Tc superconducting temperature. The input is 10 as shown in in FIG. 3. The output is 11 as shown in in FIG. 3. The spiral variable time delay device is reciprocal in nature.

Figure 5:
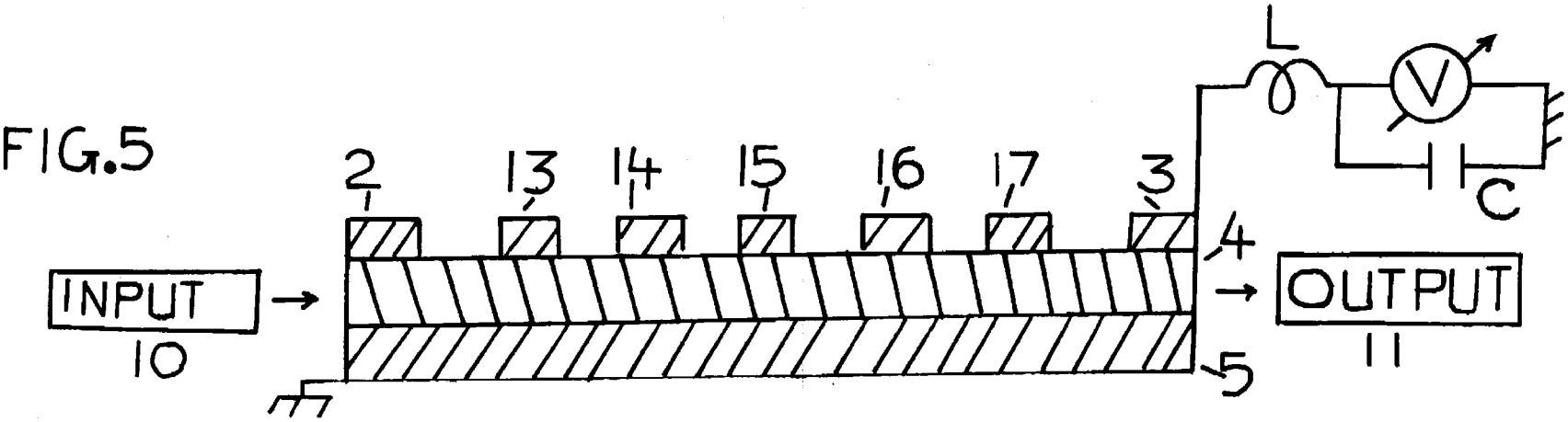
FIG. 5 is another longitudinal cross-section across section line AB of FIG. 3.

FIG. 5 is another longitudinal cross-section across section line AB of FIG. 3. A single crystal high Tc superconductor material is the substrate 5 which is connected to the ground. A film of a single crystal ferroelectric material is 4. The cross-sections of the different sections of the spiral arms, made of a single crystal high Tc superconductor, such as YBCO, are shown by 13, 14, 15, 16 and 17. The input quarter wave impedance matching transformer is 2. The output quarter wave impedance matching transformer is 3. There are areas between 2 and 13, 13 and 14, 14 and 15, 15 and 16, 16 and 17, and 17 and 3, which are not deposited with a single crystal high Tc superconductor material. The inductance L provides a high impedance at an operating frequency of the time delay device. Any RF energy remaining after L is by passed to the ground by the capacitor C. A bias voltage V changes the permittivity of the film of a single crystal ferroelectric material and consequently the variable time delay of the time delay device. The spiral time delay device is a monolithic microwave integrated circuit (MMIC). The spiral time delay device is operated at a high Tc superconducting temperature. The input is 10. The output is 11. A matching transformer is 3. The spiral variable time delay device is reciprocal in nature.

Figure 6:
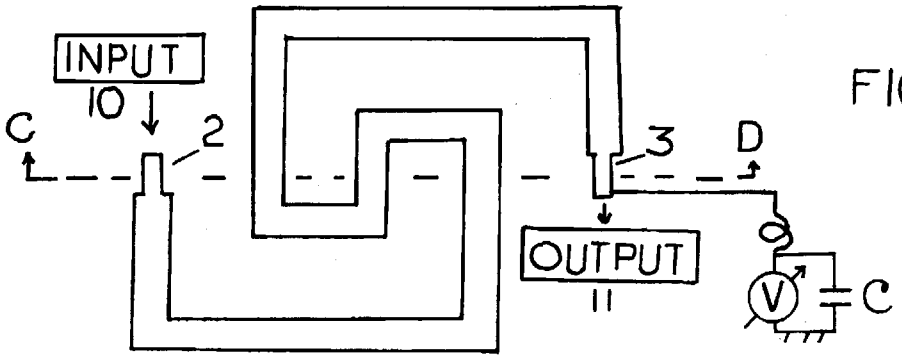
FIG. 6 shows a square shaped embodiment of my invention.

FIG. 6 shows another embodiment of my invention, a monolithic square time delay device 20. Only a small number of turns is shown for simplicity. In practice, n number of turns are used depending on the requirements. The permittivity of the underlying film of a single crystal ferroelectric material is generally large and consequently the impedance of the microstrip square shaped time delay device is small. For matching the impedance of the square shaped delay device to the impedance of an input circuit of the time delay device, a matching transformer 2 is used. For matching the impedance of a microstrip line of the square shaped time delay device to the impedance of an output circuit of the time delay device, a quarter wavelength long, at an operating frequency of the time delay device, is used. A matching transformer is 3. The inductance L provides a high impedance at an operating frequency of the time delay device. Any RF energy remaining after the inductance L is by passed to the ground by the capacitor C. A bias voltage V changes the permittivity of the film of a single crystal ferroelectric material and consequently the differential time delay of the square shaped time delay device. The time delay is operated at a high Tc superconducting temperature. The time delay device is reciprocal in nature.

Figure 7:
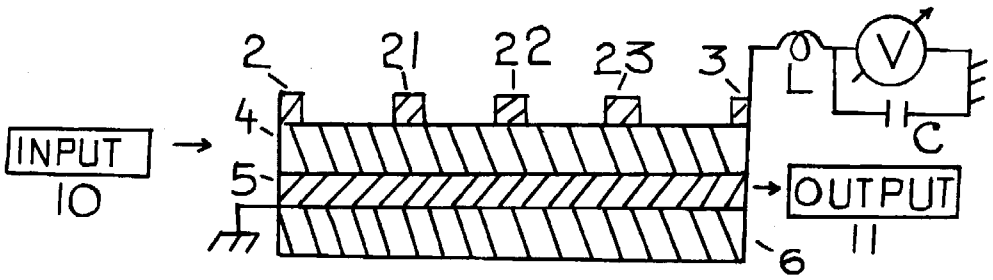
FIG. 7 is a longitudinal cross-section of FIG. 6 through section line CD.

FIG. 7 is a longitudinal cross-section of FIG. 6 through section line CD. A single crystal dielectric, such as sapphire, is the substrate 6. On top of the single crystal dielectric substrate 6 is deposited a film 5 of a single crystal high Tc superconductor material, such as YBCO, which is grounded. On top of the film 5 of a single crystal high Tc superconductor material is deposited a film 4 of a single crystal ferroelectric material, such as $KTa_{1-x}Nb_xO_3$, $Sr_{1-x}Pb_xTiO_3$, where a value of x varies between 0.005 and 0.7 with a Curie temperature slightly below a high Tc superconducting temperature. The cross-sections of the different sections of the square spiral arms, deposited with a film of a single crystal high Tc superconductor material, are shown by 21, 22 and 23. The input quarter wave length long matching transformer is 2. The output quarter wave length long matching transformer is 3. There are areas, between 2 and 21, 21 and 22, 22 and 23, and 23 and 3, which are not deposited with a film of a single crystal high Tc superconductor material. The inductance L provides a high impedance at an operating frequency of the time delay device. Any RF energy remaining after the inductance L is by passed to ground by the capacitor C. A bias voltage V changes the permittivity of the single crystal ferroelectric film and consequently the differential time delay of the square time delay device. The time delay device is operated at a high Tc superconducting temperature slightly above the Curie temperature of the ferroelectric film. The square shaped time delay device is a monolithic microwave integrated circuit (MMIC).

Figure 8:
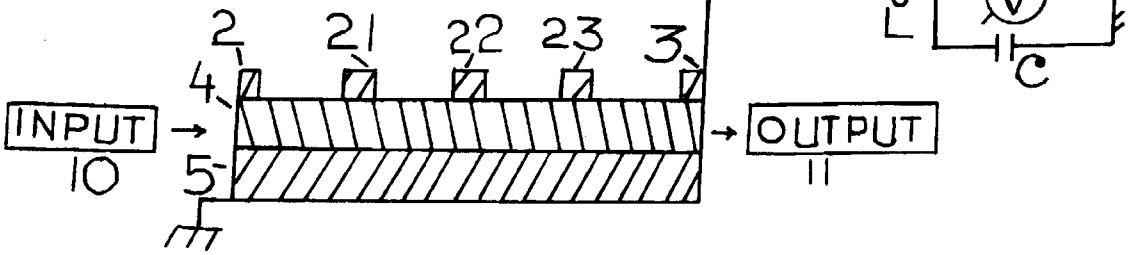
FIG. 8 is another longitudinal cross-section of FIG. 6 through section line CD.

FIG. 8 is another longitudinal cross-section of FIG. 6 through section line CD. A single crystal high Tc superconductor material, such as YBCO, is the substrate 5 and which is grounded. On top of the substrate 5 of a single crystal high Tc superconductor material is deposited a film 4 of a single crystal ferroelectric material, such as $KTa_{1-x}Nb_xO_3$, $Sr_{1-x}Pb_xTiO_3$, where a value of x varies between 0.005 and 0.7 with a Curie temperature slightly below a high Tc superconducting temperature. The cross-sections of the different sections of the square spiral arms, deposited with a film of a single crystal high Tc superconductor material, are shown by 21, 22 and 23. The input quarter wave length long matching transformer is 2. The output quarter wave length long matching transformer is 3. There are areas, between 2 and 21, 21 and 22, 22 and 23, and 23 and 3, which are not deposited with a film of a single crystal high Tc superconductor material. The inductance L provides a high impedance at an operating frequency of the time delay device. Any RF energy remaining after the inductance L is bypassed to the ground by the capacitor C. A bias voltage V changes the permittivity of the single crystal ferroelectric film and consequently the differential time delay of the square time delay device. The time delay device is operated at a high Tc superconducting temperature slightly above the Curie temperature of the ferroelectric film. The square shaped time delay device is a monolithic microwave integrated circuit (MMIC).

Figure 9:
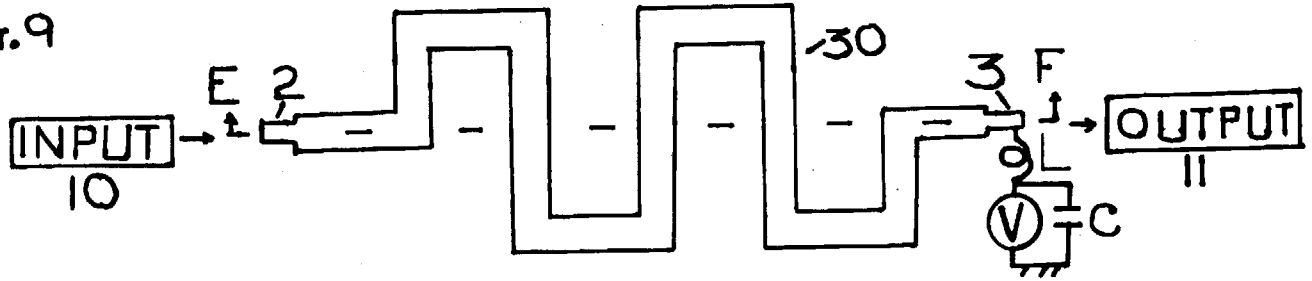
FIG. 9 is a top view of a meander line embodiment of my invention

FIG. 9 shows a top view of another embodiment of my invention, a monolithic meander line time delay device 30. Only a small number of turns is shown for simplicity. In practice, n number of delay lines are used depending on the requirements. The permittivity of the underlying single crystal ferroelectric film is generally large. Consequenctly the impedance of the microstrip meander line time delay device is small. For matching the impedance of the microstrip line of the meander line time delay device to an impedance of an input circuit of the time delay device, a quarter wavelength long, at an operating frequency of the time delay device, matching transformer 2 is used. For matching the impedence of the microstrip line time delay device to the impedance of an output circuit of the time delay device, a quarter wavelength long, at an operating frequency of the time delay device, matching transformer 3 is used. The inductance L provides a high impedance at an operating frequency of the meander line time delay device. Any RF energy remaining after the inductance L is bypassed to the ground through the capacitor C. A bias voltage changes the permittivity of the underlying film of a single crystal ferroelectric material and consequenctly the time delay of the meander line time delay device. The time delay device is operated at a high Tc superconducting temperature slightly above the Curie temperature of the ferroelectric film. The time delay device is reciprocal in nature. INPUT is 10 and OUTPUT is 11.

Figure 10:
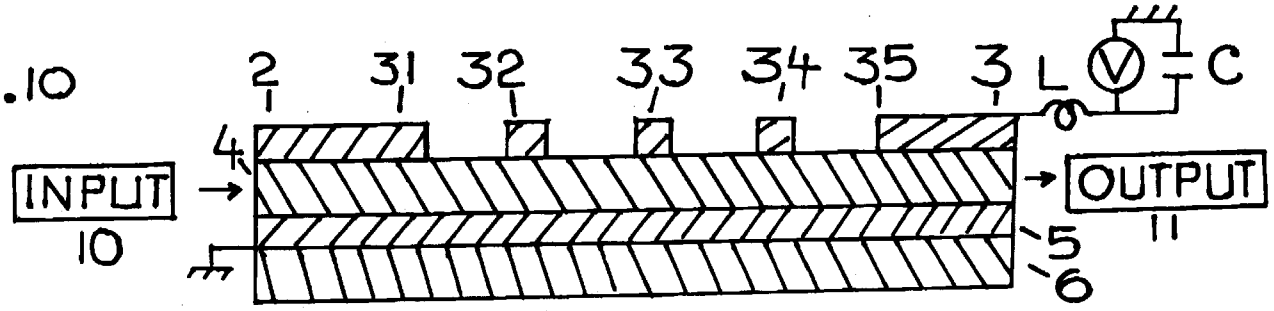
FIG. 10 is a longitudinal cross-section of FIG. 9 through section line EF.

FIG. 10 is a longitudinal cross-section of FIG. 9 through section line EF. A single crystal dielectric material, such as sapphire, is the substrate 6. On top of the single crystal dielectric substrate 6 is deposited a film 5 of a single crystal high Tc superconductor material, such as YBCO. On top of the film 5 of a single crystal high Tc superconductor material is deposited a film of a single crystal ferroelectric material 4, such as $KTa_{1-x}Nb_xO_3$, $Sr_{1-x}Pb_xTiO_3$, where a value of x varies between 0.005 and 0.7 having a Curie temperature slightly below a high Tc superconducting temperature. The cross-sections of the meander line arms, deposited with a film of a single crystal high Tc superconductor material are shown by 31, 32, 33, 34 and 35. The input quarter wave length long matching transformer is 2 connected to single crystal high Tc superconductor material single crystal high Tc superconductor material 31. The output quarter wave length long matching transformer is 3 connected to single crystal high Tc superconductor material single crystal high Tc superconductor material 35. There are areas, between 31 and 32, 32 and 33, 33 and 34, and 34 and 35, which are not deposited with a film of a single crystal high Tc superconductor material. The inductance L provides a high impedance at an operating frequency of the time delay device. Any RF energy remaining after the inductance L, is by passed to the ground by the capacitor C. A bias voltage V applied to the film of a single ferroelectric material changes its permittivity and consequently the time delay of the meander line time delay device. The meander line time delay device is operated at a high Tc superconducting temperature slightly above the Curie temperature of the ferroelectric film. The meander line time delay device is a monolithic microwave integrated circuit (MMIC).

Figure 11:
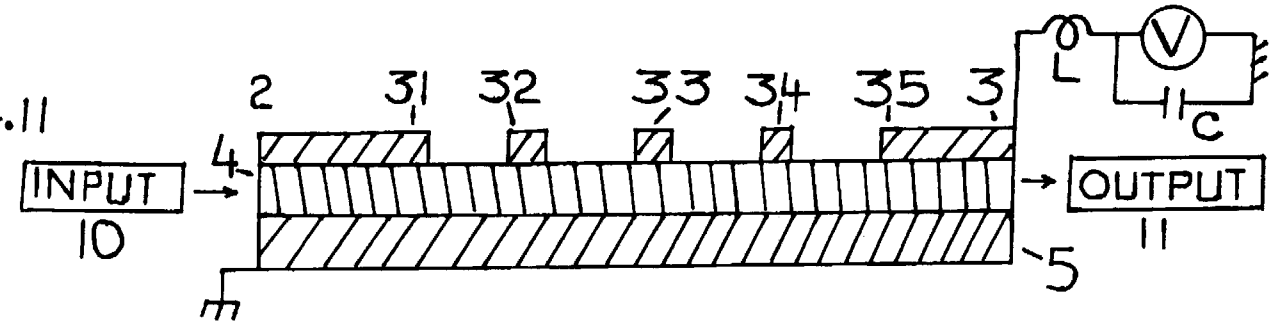
FIG. 11 is another longitudinal cross-section of FIG. 9 through section line EF.

FIG. 11 is another longitudinal cross-section of FIG. 9 through section line EF. A single crystal high Tc superconductor, such as YBCO, is the substrate 5. On top of the substrate 5 of a single crystal high Tc superconductor material is deposited a film of a single crystal ferroelectric material 4, such as $KTa_{1-x}Nb_xO_3$, $Sr_{1-x}Pb_xTiO_3$, where a value of x varies between 0.005 and 0.7 having a Curie temperature slightly below a high Tc superconducting temperature. The cross-sections of the meander line arms, deposited with a film of a single crystal high Tc superconductor material are shown by 31, 32 33, 34 and 35. The input quarter wave length long matching transformer is 2 connected to single crystal high Tc superconductor material single crystal high Tc superconductor material 31. The output quarter wave length long matching transformer is 3 connected to single crystal high Tc superconductor material 35. There are areas, between 31 and 32, 32 and 33, 33 and 34, and 34 and 35, which are not deposited with a film of a single crystal high Tc superconductor material. The inductance L provides a high impedance at an operating frequency of the time delay device. Any RF energy remaining after the inductance L, is by passed to the ground by the capacitor C. A bias voltage V applied to the film of a single crystal ferroelectric material changes its permittivity and consequenctly the time delay of the meander line time delay device. The meander line time delay device is operated at a high Tc superconducting temperature slightly above the Curie temperature of the ferroelectric film. The meander line time delay device is a monolithic microwave integrated circuit (MMIC). INPUT is 10 and OUTPUT is 11.

Figure 12:
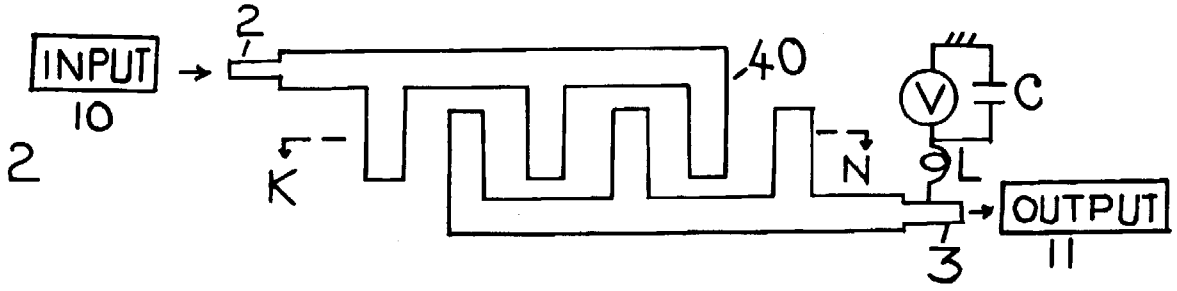
FIG. 12 shows a top view of an interdigitated embodiment of my invention.

FIG. 12 shows a top view of another embodiment of my invention, an interdigitated variable time delay device. It is a film of a single crystal superconductor material, such as YBCO. Underneath the film of a single crystal high Tc superconductor material is a film of a single crystal ferroelectric material. Generally, the permittivity of the ferroelectric material is large. Consequently, the impedance of the microstrip line 40 is low. To match the microstrip line of an interdigitated time delay device to the impedance of an input circuit of the time delay device, a quarter wavelength long, at an operating frequency of the time delay device, matching transformer 2 is used. To match the impedance of the microstrip line 40 of the interdigitated time delay device to the impedance of an output circuit of the time delay device, a quarter wavelength long, at an operating frequency of the time delay device, transformer 3 is used. The inductance L offers a high impedance at an operating frequency of the time delay device. Any RF energy remaining after the inductance L is by passed to the ground by the capacitor C. A bias voltage V is applied to the interdigitated time delay device to obtain a differential time delay. For simplicity, only a small number of fingers are shown in the interdigitated time delay device. In practice, n number of fingers is used to meet the requirements. The interdigitated time delay device is operated at a high Tc superconducting temperature. The time delay device is reciprocal in nature. INPUT is 10 and OUTPUT is 11.

Figure 13:
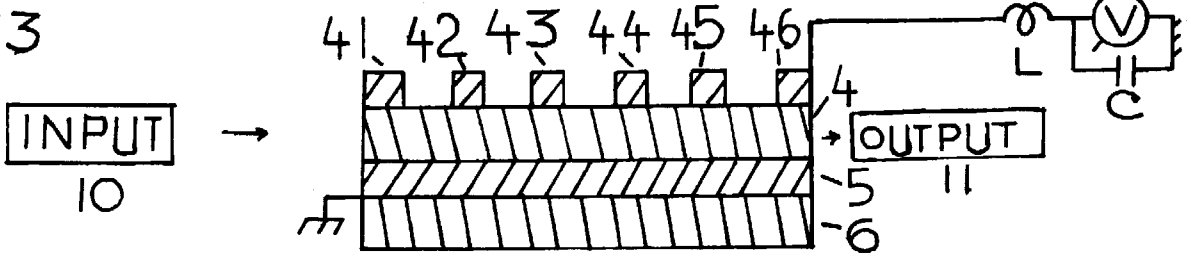
FIG. 13 is a longitudinal cross-section of FIG. 12 through section line KN.

FIG. 13 is a longitudinal cross-section of FIG. 12 through section line KN. A single crystal dielectric, such as sapphire, is a substrate 6. On top of the single crystal dielectric substrate 6 is deposited a film 5 of a single crystal high Tc superconductor, such as YBCO, which is grounded. On top of the film 5 of a single crystal high Tc superconductor is deposited a film of a single crystal ferroelectric material 4, such as $KTa_{1-x}Nb_xO_3$, $Sr_{1-x}Pb_xTiO_3$ where a value of x varies between 0.005 and 0.7 with a Curie temperature slightly below the high Tc superconducting temperature. The cross-sections of the interdigitated fingers, deposited with a film of a single crystal high Tc superconductor material, are shown by 41, 42, 43, 44, 45 and 46. There are areas, between 41 and 42, 42 and 43, 43 and 44, 44 and 45, and 45 and 46, which are not deposited with a film of a single crystal high Tc superconductor material, The inductance L provides a high impedance at an operating frequency of the time delay device. Any RF energy remaining after L is by passed to the ground by the capacitor C. A bias voltage V is applied to change the permittivity of the single crystal ferroelectric film and thus to produce a differential time delay. The interdigitated time delay device is operated at a high Tc superconducting temperature slightly above the Curie temperature of the ferroelectric film. The interdigitated time delay device is a monolithic microwave integrated circuit (MMIC). INPUT is 10 and OUTPUT is 11.

Figure 14:
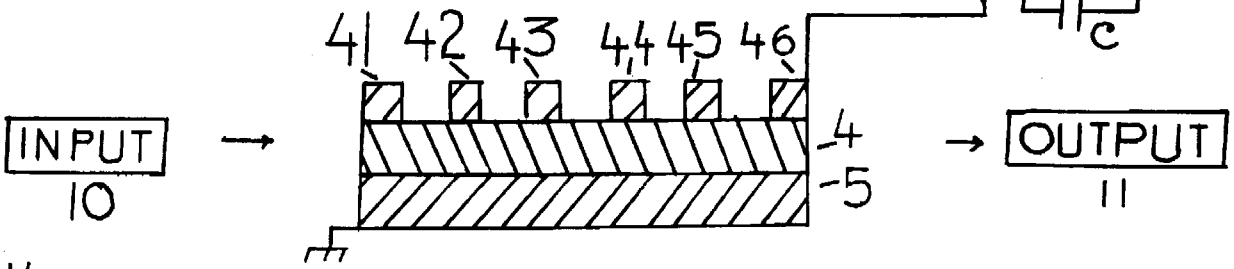
FIG. 14 is another longitudinal cross-section of FIG. 12 through section line KN.

FIG. 14 is another longitudinal cross-section of FIG. 12 through section line KN. A single crystal high Tc superconductor, such as YBCO is a substrate 5 and which is grounded. On top of the substrate 5 of a single crystal high Tc superconductor is deposited a film of a single crystal ferroelectric material 4, such as $KTa_{1-x}Nb_xO_3$, $Sr_{1-x}Pb_xTiO_3$ where a value of x varies between 0.005 and 0.7 with a Curie temperature slightly below the high Tc superconducting temperature. The cross-sections of the interdigitated fingers, deposited with a film of a single crystal high Tc superconductor material, are shown by 41, 42, 43, 44, 45 and 46. There are areas, between 41 and 42, 42 and 43, 43 and 44, 44 and 45, and 45 and 46, which are not deposited with a film of a single crystal high Tc superconductor material. The inductance L provides a high impedance at an operating frequency of the time delay device. Any RF energy remaining after L is by passed to the ground by the capacitor C. A bias voltage V is applied to change the permittivity of the single crystal ferroelectric film and thus to produce a differential time delay. The interdigitated time delay device is operated at a high Tc superconducting temperature slightly above the Curie temperature of the ferroelectric film. The interdigitated time delay device is a monolithic microwave integrated circuit (MMIC). INPUT is 10 and OUTPUT is 11.

Figure 15:
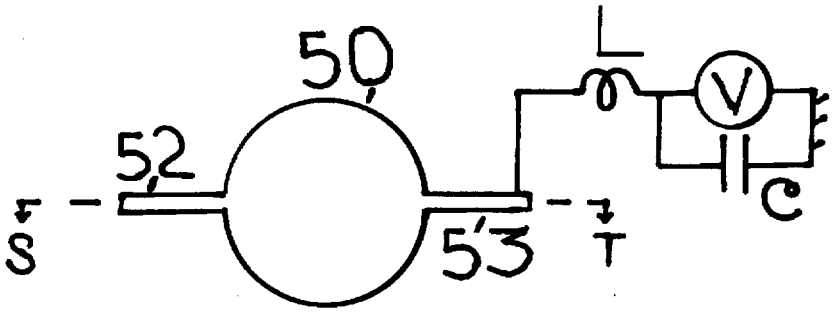
FIG. 15 is a top view of a circular embodiment of my invention.

FIG. 15 is a top view of another embodiment of my invention, a circular monolithic time delay device. It is a film 50 of a single crystal high Tc superconductor material. Underneath the high Tc superconductor film is a film of a single crystal ferroelectric material. The wires connected to the time delay device are 52 and 53. The time delay device is operated at a high Tc superconducting temperature slightly above the Curie temperature of the single crystal ferroelectric film. An inductance L provides a high impedance at an operating frequency of the time delay device. Any RF energy remaining present after the inductance L is by passed to the ground by the capacitor C. A bias voltage V is applied to the time delay device to change the permittivity of the ferroelectric film and as such the time delay of the time delay device.

Figure 16:
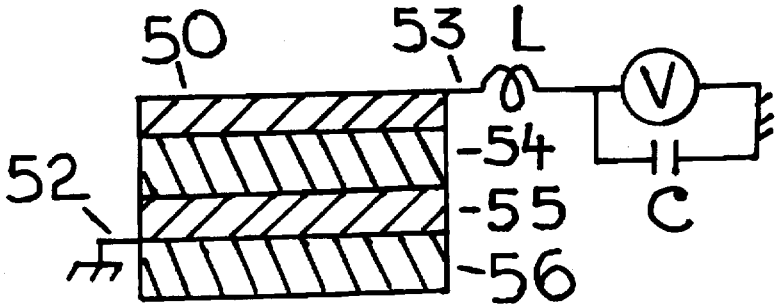
FIG. 16 is a longitudinal cross-section of the circular time delay device shown in FIG. 15 through section line ST.

FIG. 16 is a longitudinal cross-section of the circular time delay device shown in FIG. 15 through section line ST. A single crystal dielectric material, such as sapphire, forms the substrate 56. On top of the substrate 56 is a film 55 of a single crystal high Tc superconductor material which is grounded. On top of the film 55 of a high Tc superconductor material is a film 54 of a single crystal ferroelectric material. On top of the film 54 of a single crystal ferroelectric material is a film 50 of a single crystal high Tc superconductor material. The wires connected to the circular time delay device are 52 and 53. An inductance L provides a high impedance at an operating frequency of the circular time delay device. Any RF energy remaining after the impedance L is by passed to the ground by the capacitor C. A bias voltage V applied to the single crystal ferroelectric film changes the permittivity of the ferroelectric film and as such the differential time delay of the circular time delay device.

The circular time delay device is a monolithic microwave integrated circuit (MMIC).

Figure 17:
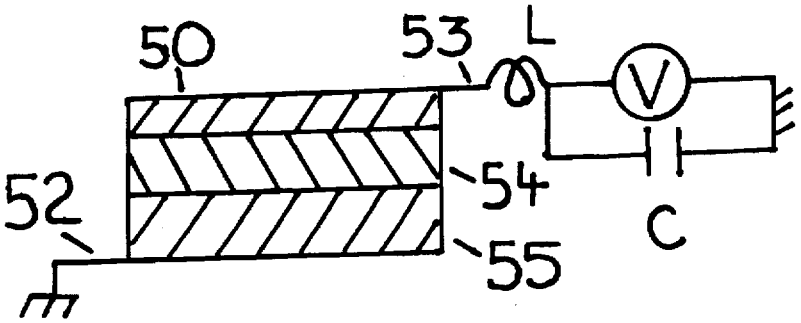
FIG. 17 is another longitudinal cross-section of the circular time delay device shown in FIG. 15 through section line ST.

FIG. 17 is another longitudinal cross-section of the circular time delay device shown in FIG. 15 through section line ST. A single crystal high Tc superconductor material 55 is the substrate which is grounded. On top of the substrate 55 of a high Tc superconductor material is a film 54 of a single crystal ferroelectric material. On top of the film 54 of a single crystal ferroelectric material is a film 50 of a single crystal high Tc superconductor material. The wires connected to the circular time delay device are 52 and 53. An inductance L provides a high impedance at an operating frequency of the circular time delay device. Any RF energy remaining after the impedance L is by passed to the ground by the capacitor C. A bias voltage V applied to the single crystal ferroelectric film changes the permittivity of the ferroelectric film and as such the differential time delay of the circular time delay device. The circular time delay device is a monolithic microwave integrated circuit (MMIC).

In FIG. 15, FIG. 16 and FIG. 17, the wires 52 and 53 can be connected on the same side of the circular time delay device. They can also be conductors. All embodiments are operated at a high Tc superconducting temperature slightly above the Curie temperature of the ferroelectric film.

It should be understood that the foregoing disclosure relates to only typical embodiments of the invention and that numerous modification or alternatives may be made therein by those of ordinary skill in art without departing from the spirit and the scope of the invention as set forth in the appended claims. Specifically, the invention contemplates various dielectrics including sapphire, lanthanum aluminate, ferroelectrics, ferroelectric liquid crystals (FLCs), high Tc superconducting materials including YBCO, TBCCO, impedances, MMICs, time delay configurations and frequencies.

What is claimed is:

1. A high Tc superconducting variable time delay device having an input, an output, an operating frequency, a single crystal dielectric material, being operated at high Tc superconducting temperature, having a single crystal $KTa_{1-x}Nb_xO_3$ ferroelectric material with an electric field dependent permittivity, having a Curie temperature, and comprising of:

a first layer comprised of a single crystal dielectric material;

a second layer comprised of a film of a single crystal high Tc superconductor material disposed on said single crystal dielectric material first layer;

a third layer comprised of a film of said single crystal ferroelectric material disposed on said single crystal high Tc superconductor film second layer;

a fourth layer comprised of a spiral shaped first microstrip line section disposed on said ferroelectric film third layer;

a second microstrip line section disposed on said ferroelectric film, being quarter wave length long at said operating frequency of said time delay device, for matching, over various bias electric fields, the impedance of an input of said time delay device to the impedance of said first microstrip line and being a part thereof;

a third microstrip line section disposed on said ferroelectric film, being quarter wave length long at said operating frequency of said time delay device, for matching, over various bias electric fields, the impedance of an output of said time delay device to the impedance of said first microstrip line and being a part thereof;

an ground elecrical being connected to said single high Tc superconductor film of said second layer:, a film of a single crystal high Tc superconductor material continuously defining said first, second and third microstrip lines;

said time delay device having a capability to operate up to a power level of 0.5 MW;

means, connected to the microstrip lines, for applying a variable bias electric field to change said permittivity of said ferroelectric film of said time delay device; and said time delay device being operated at a high Tc superconducting temperature slightly above said Curie temperature of said ferroelectric film to avoid hysterisis.

2. A high Tc superconducting variable time delay device of claim 1:

wherein the single crystal high Tc superconductor material is YBCO.

3. A high Tc superconducting variable time delay device of claim 1:

wherein the single crystal dielectric material of the first layer being single crystal lanthanum aluminate.

4. A high Tc superconducting variable time delay device of claim 1:

wherein the single crystal high Tc superconductor material is TBCCO.

5. A high Tc superconducting variable time delay device of claim 1:

wherein the single crystal dielectric material being sapphire.

6. A high Tc superconducting variable time delay device of claim 1:

wherein the single crystal dielectric material being sapphire and the single crystal high Tc superconductor material being TBCCO.

7. A high Tc superconducting variable time delay device having an input, an output, an operating frequency, a single crystal dielectric material, being operated at high Tc superconducting temperature, having a single crystal $KTa_{1-x}Nb_xO_3$ ferroelectric material with an electric field dependent permittivity, having a Curie temperature, and comprising of:

a first layer comprised of a single crystal dielectric material;

a second layer comprised of a film of a single crystal high Tc superconductor material disposed on said single crystal dielectric material first layer;

a third layer comprised of a film of said single crystal ferroelectric material disposed on said single crystal high Tc superconductor film second layer;

a fourth layer comprised of a meander line shaped first microstrip line section having n line sections disposed on said ferroelectric film third layer;

a second microstrip line section disposed on said ferroelectric film, being quarter wave length long at said operating frequency of said time delay device, for matching, over various bias electric fields, the impedance of an input of said time delay device to the impedance of said first microstrip line and being a part thereof;

a third microstrip line section disposed on said ferroelectric film, being quarter wave length long at said operating frequency of said time delay device, for matching, over various bias electric fields, the impedance of an output of said time delay device to the impedance of said first microstrip line and being a part thereof;

an electrical ground being connected to said single high Tc superconductor film of said second layer, a film of a single crystal high Tc superconductor material continuously defining said first, second and third microstrip lines;

said time delay device having a capability to operate up to a power level of 0.5 MW;

means, connected to the microstrip lines, for applying a variable bias electric field to change said permittivity of said ferroelectric film of said time delay device; and said time delay device being operated at a high Tc superconducting temperature slightly above said Curie temperature of said ferroelectric film to avoid hysterisis.

8. A high Tc superconducting variable time delay device of claim 7:

wherein the single crystal high Tc superconductor material is YBCO.

9. A high Tc superconducting variable time delay device of claim 7:

wherein the single crystal dielectric material of the first layer being single crystal lanthanum aluminate.

10. A high Tc superconducting variable time delay device of claim 7:

wherein, the single crystal dielectric being sapphire and the single crystal high Tc superconductor material being TBCCO.

11. A high Tc superconducting variable time delay device of claim 7:

wherein the single crystal high Tc superconductor material is TBCCO.

12. A high Tc superconducting variable time delay device of claim 7:

wherein the single crystal dielectric material being sapphire.

13. A high Tc superconducting variable time delay device of claim 7:

wherein, the single crystal dielectric being sapphire and the single crystal high Tc superconductor material being YBCO.

14. A high Tc superconducting variable time delay device having an input, an output, an operating frequency, a single crystal dielectric material, being operated at high Tc superconducting temperature, having a single crystal $KTa_{1-x}Nb_xO_3$ ferroelectric material with an electric field dependent permittivity, having a Curie temperature, and comprising of:

a first layer comprised of a single crystal dielectric material;

a second layer comprised of a film of a single crystal high Tc superconductor material disposed on said single crystal dielectric material first layer;

a third layer comprised of a film of said single crystal ferroelectric material disposed on said single crystal high Tc superconductor film second layer;

a fourth layer comprised of a first microstrip line section disposed on said ferroelectric film third layer;

a second microstrip line section disposed on said ferroelectric film, being quarter wave length long at said operating frequency of said time delay device, for matching, over various bias electric fields, the impedance of an input of said time delay device to the impedance of said first microstrip line and being a part thereof;

a third microstrip line section disposed on said ferroelectric film, being quarter wave length long at said operating frequency of said time delay device, for matching, over various bias electric fields, the impedance of an output of said time delay device to the impedance of said first microstrip line and being a part thereof;

an electrical ground being connected to said single high Tc superconductor film of said second layer;

a film of a single crystal high Tc superconductor material continuously defining said first, second and third microstrip lines;

said time delay device having a capability to operate up to a power level of 0.5 MW;

means, connected to the microstrip lines, for applying a variable bias electric field to change said permittivity of said ferroelectric film of said time delay device; and said time delay device being operated at a high Tc superconducting temperature slightly above said Curie temperature of said ferroelectric film to avoid hysterisis.

15. A high Tc superconducting variable time delay device of claim 14:

wherein the single crystal high Tc superconductor material is YBCO.

16. A high Tc superconducting variable time delay device of claim 14:

wherein the single crystal dielectric material of the first layer being single crystal lanthanum aluminate.

17. A high Tc superconducting variable time delay device of claim 14:

wherein the single crystal high Tc superconductor material is TBCCO.

18. A high Tc superconducting variable time delay device of claim 14:

wherein the single crystal dielectric material being sapphire.

19. A high Tc superconducting variable time delay device of claim 14:

wherein the single crystal ferroelectric being KTN, the single crystal dielectric being sapphire and the single crystal high Tc superconductor material being TBCCO.

* * * * *